US007028427B2

(12) United States Patent
Crawford

(10) Patent No.: US 7,028,427 B2
(45) Date of Patent: Apr. 18, 2006

(54) RIFLE FOREARM ASSIST BRACE

(76) Inventor: John Crawford, 20 Davis Rd., Portsmouth, NH (US) 03801

( * ) Notice: Subject to any disclaimer, the term of this patent is extended or adjusted under 35 U.S.C. 154(b) by 54 days.

(21) Appl. No.: 10/710,718

(22) Filed: Jul. 29, 2004

(65) Prior Publication Data

US 2005/0039368 A1 Feb. 24, 2005

Related U.S. Application Data

(60) Provisional application No. 60/492,249, filed on Aug. 4, 2003.

(51) Int. Cl.
*F41C 23/00* (2006.01)

(52) U.S. Cl. ..... 42/72

(58) Field of Classification Search ..... 42/90, 42/94, 106; 248/301, 304, 303
See application file for complete search history.

(56) References Cited

U.S. PATENT DOCUMENTS 46,365 A 2/1865 Kinman
2,295,370 A * 9/1942 Tritt ..... 248/308
2,436,175 A * 2/1948 Neal ..... 89/127
3,209,481 A 10/1965 Gilbert ..... 42/71
3,260,489 A * 7/1966 Hentzi ..... 248/215
4,248,399 A * 2/1981 Gipson ..... 248/552
5,068,992 A 12/1991 Velezis et al. ..... 42/72
5,180,874 A 1/1993 Troncoso, Jr. ..... 42/72
5,351,867 A 10/1994 Vest ..... 224/224
5,353,538 A 10/1994 Hakedal et al. ..... 42/85
5,491,920 A 2/1996 McCullers ..... 42/94
5,715,979 A 2/1998 Crandall ..... 224/150
5,778,589 A 7/1998 Teague ..... 42/94
5,784,820 A 7/1998 Wood ..... 42/94
6,009,655 A 1/2000 Austin ..... 42/94
6,016,620 A 1/2000 Morgan ..... 42/94
6,158,159 A 12/2000 Zekas ..... 42/94
6,250,009 B1 6/2001 Leontuk ..... 42/72

* cited by examiner

*Primary Examiner*—Mike Carone
*Assistant Examiner*—Gabriel J. Klein
(74) *Attorney, Agent, or Firm*—Phillip E. Decker; Mesmer & Deleault, PLLC

(57) ABSTRACT

A support brace that permits the user to fire a rifle with one hand has a C-shaped rifle butt attachment that removably secures to a rifle butt by friction, and a forearm brace member, attached with or without a hinge. Left handed or right handed shooters can use the brace.

4 Claims, 3 Drawing Sheets

RIFLE FOREARM ASSIST BRACE

BACKGROUND OF INVENTION

1. Field of the Invention

The present invention relates generally to a support brace for a gun and the like and, more particularly, to a hinged forearm-support brace for a rifle comprised of a C-shaped rifle butt attachment member having a forearm brace member hingedly attached thereto.

2. Description of the Related Art

The hobby of rifle shooting for target shooting has been enjoyed by many. It is a hobby where skill is constantly employed and continued practice will always improve a participant. While no one will argue that the high-powered rifle is a formidable weapon, it cannot be easily handled, managed, or used with only one arm or hand. To adequately control a rifle or other long gun, two hands are necessary. Even for those rifles with pistol-type grips, the combination of weigh and leverage that can be placed on the wrist necessitates the user placing the rear of the rifle or butt against the shoulder for leverage before the shot, and the back-kick from the shot can cause dangerous and uncontrolled consequences if the rifle is allowed to move off of the user's shoulder. In effect, it is almost impossible to engage in controlled one-hand firing of a rifle, even though such a scheme would be a definite advantage when holding a flashlight, opening a door, or should the user be disabled. Other military and law enforcement uses would also benefit from such a capability. What is needed, therefore, is a support brace that permits the user to fire, carry, and support a rifle with one hand, either left handed or right handed, thereby freeing the other hand for holding other objects. The rifle can be stabilized against a shooter's forearm in an easy manner, thus providing true one-handed operation.

SUMMARY OF INVENTION

A support brace that permits the user to fire, carry, and support a rifle with one hand comprises a C-shaped rifle butt attachment that removably secures to a rifle butt by friction, and either a curvilinear or a linearly elongated forearm brace member, attached with or without a hinge. These and other features and embodiments of the invention will be made clear in the following drawings, description, and claims.

DETAILED DESCRIPTION

Figure 1:
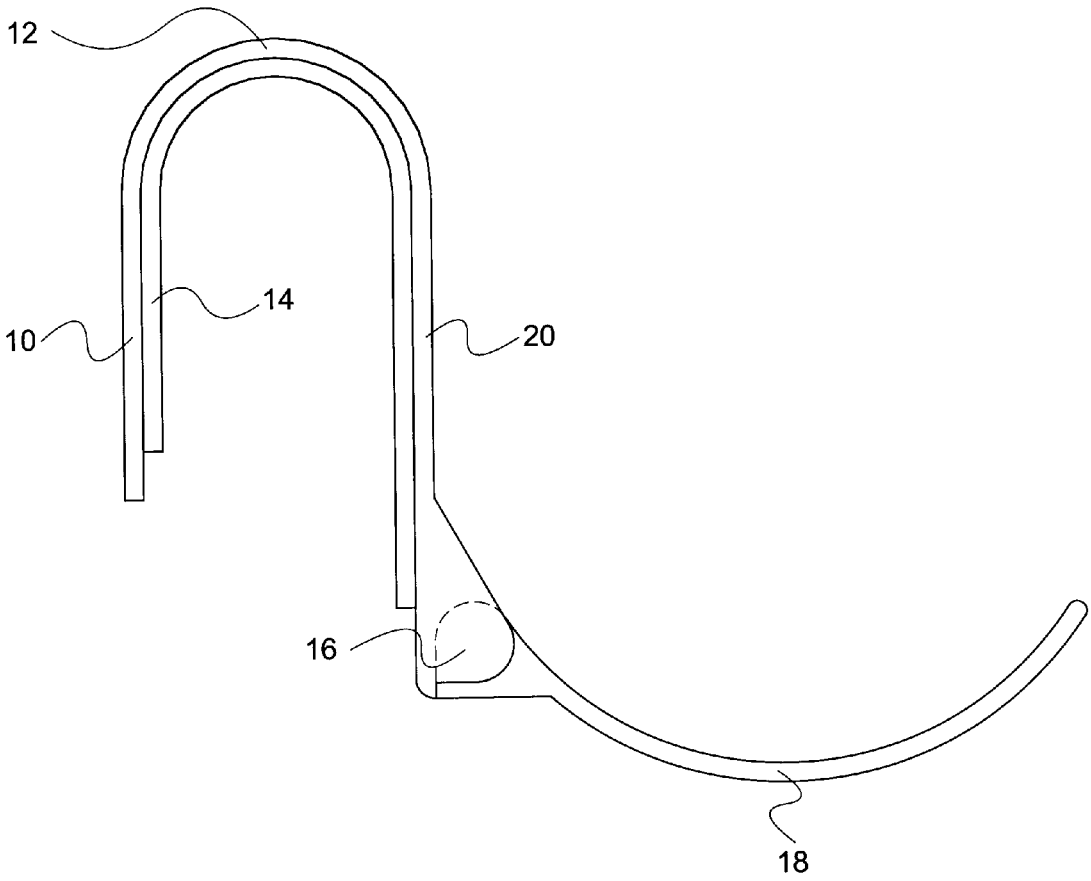
FIG. 1 is a side view of the preferred embodiment of a hinged rifle forearm assist brace according to the present invention.

The invention is a support brace that permits the user to fire, carry, and support a rifle with one hand comprising a C-shaped rifle butt attachment that removably secures to a rifle butt by friction, and either a curvilinear or a linearly elongated forearm brace member, attached with or without a hinge. Referring now to FIG. 1, a rifle forearm assist brace is an apparatus designed to improve the usage, stability, and controllability of a rifle when firing one-handed. The C-shape has two substantially parallel ends 10, 20 joined by a semi-circular section 12 sized to conform to the cross section of a standard rifle butt. A lining material 14 is applied to the inside surface of the C-shape as shown, for example, by gluing. The preferred embodiment of lining material 14 is foam rubber, but other materials can be used. The lining material 14 is selected to grip the rifle butt material. The C-shape and lining material 14 is held in place vertically over the butt of the gun by a friction fit. The lining not only acts to hold the brace in place, but also protects the rifle stock from scratches or damage from the brace. It is also envisioned that the brace could be permanently mounted to the rifle stock with the aid of a fastening devices such as screws, or incorporated directly therein to accomplish the benefits of the present teachings.

A curvilinear forearm brace member 18 extends outward from the "C"-shape in a manner substantially perpendicular to the rifle stock and would "lock" under the user's forearm because of a stop created with an optional hinge mechanism 16 joining the C-shape and brace member 18, thus preventing movement during shooting and allowing one-armed firing. The brace can be provided with or without a hinge mechanism 16. The brace is envisioned to be a provided in a solid, one-piece design, or a foldable two-piece design in which the elongated forearm brace member 18 folds up against the rifle stock and C-shape. The unit allows for use by left-handed or right-handed shooters.

The length of the elongated forearm brace member 18 is preferably substantially the same width as a human forearm. A suitable length is about 3-¼ inches, for example. The elongated forearm brace member 18 can be straight or curved to a users forearm as shown, that is, curvilinear. If the member 18 is straight, a boss extending upwards from the end is provided. The boss is to help keep the user's forearm in the brace and prevent it from falling off the end. A suitable height of the boss is about one inch, for example. If the member 18 is curved as shown, then the boss is not provided.

Figure 2:
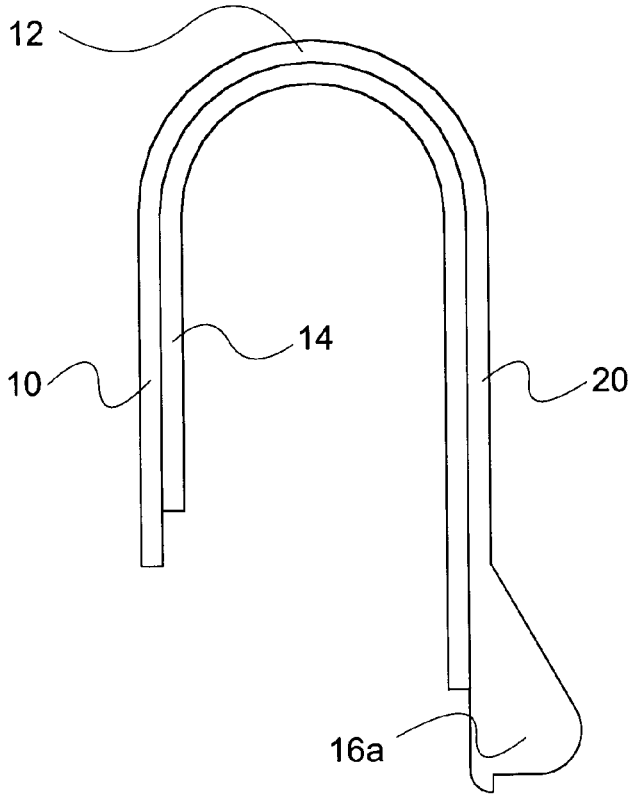
FIG. 2 is a side view of the C-shaped attachment alone.
Figure 3:
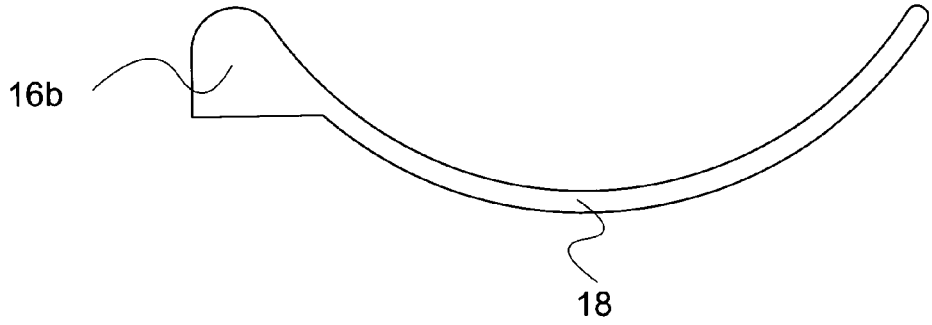
FIG. 3 is a side view of a curvilinear forearm brace member alone.

FIG. 2 shows the C-shape alone, and the hinge portion 16*a*. A stop can be seen just below the hinge portion to stop rotation of the brace member. Likewise, FIG. 3 shows the brace member 18 alone. Its hinge portion 16*b* and stop is shown.

Figure 4:
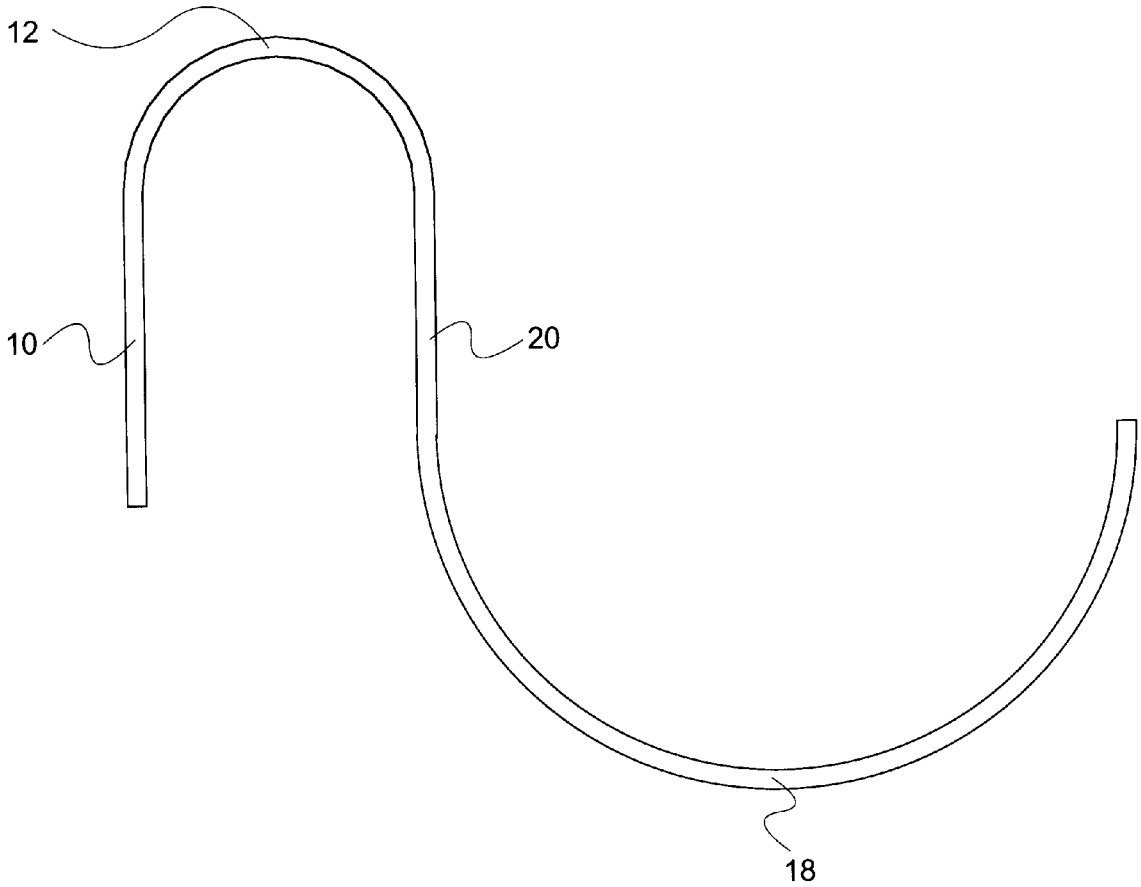
FIG. 4 is a side view non-hinged rifle forearm assist brace according to the present invention.

FIG. 4 is a side view of a non-hinged embodiment of the present invention. This view does not show the lining material, which can be added.

The materials required to produce the rifle forearm assist brace are all readily available and well known to manufactures of goods of this type. The C-shape and brace member 18 should be made of a substantially rigid material such as aluminum, steel, stainless steel, heavy plastic or fiberglass. It does not have to be completely rigid, since it is beneficial to slightly bend the parallel ends 10, 20 apart to slide the brace over the rifle butt to achieve the friction fit. Processes as stamping, forging, machining, injection molding and the like would be utilized to make the parts. Examples of suitable stock material sizes are ¾-inch wide strips of ⅛-inch thick material. Specific components of the invention such as the foam rubber lining material 14, and the lockable hinge 16 may be best be suited for procurement from manufactures or wholesalers who deal in goods of that nature and assembled at a final location. Alternatively, the hinge mechanism 16 can also be formed simultaneously with the C-shape and elongated brace member 18, or it could be a separate item attached to them, for example, by welding. The relatively simple yet novel design of the invention and the material of construction make the rifle forearm assist brace a cost-effective design due to the relatively low material and labor costs involved.

The user will appreciate the many benefits of using the forearm brace of this invention for one handed shooting. First, it does not require the user to brace the butt against his shoulder. Second, the weight of the gun is distributed between the user's hand near the trigger, and the user's forearm through the brace. The result is that the user will have less fatigue when carrying the gun. Third, the user's shots will be more accurate because the user is not relying on only the force of his hand clenching to support and aim the gun. The user can lift and swing the gun with his whole forearm at his elbow, and comfortably position the gun at a height required for the particular shot.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

The invention claimed is:

1. A forearm support brace for a rifle comprising:

a rifle butt; and a C-shaped rifle butt attachment, supporting said rifle butt member having a forearm brace member secured at a forearm brace proximal end substantially perpendicular to the C-shape rifle butt attachment, wherein said forearm support brace facilitates one-handed firing capability and is configured to allow for ambidextrous use.

2. The brace of claim 1, further comprising a hinge mechanism joining the C-shape and the elongated forearm brace member.

3. The brace of claim 1, wherein the C-shape is made of a formed bar having two substantially parallel ends joined by a semi-circular section sized to conform to the cross section of the rifle butt.

4. The brace of claim 1, further comprising a foam rubber lining material applied to a surface inside the C-shape selected to removably secure the brace to the rifle with a friction fit.

* * * * *